US006982377B2

(12) United States Patent
Sakurai et al.

(10) Patent No.: US 6,982,377 B2
(45) Date of Patent: Jan. 3, 2006

(54) TIME-SCALE MODIFICATION OF MUSIC SIGNALS BASED ON POLYPHASE FILTERBANKS AND CONSTRAINED TIME-DOMAIN PROCESSING

(75) Inventors: Atsuhiro Sakurai, Tsukuba (JP); Steven Trautmann, Ibaraki (JP); Daniel L. Zelazo, Shibuya-ku (JP)

(73) Assignee: Texas Instruments Incorporated, Dallas, TX (US)

( * ) Notice: Subject to any disclaimer, the term of this patent is extended or adjusted under 35 U.S.C. 154(b) by 171 days.

(21) Appl. No.: 10/739,632

(22) Filed: Dec. 18, 2003

(65) Prior Publication Data

US 2005/0132870 A1 Jun. 23, 2005

(51) Int. Cl.
*G10H 5/00* (2006.01)

(52) U.S. Cl. ..... 84/654; 704/211; 704/503

(58) Field of Classification Search ..... 84/616, 84/654; 704/205–207, 211, 503
See application file for complete search history.

(56) References Cited

U.S. PATENT DOCUMENTS

| | | | | |
|---|---|---|---|---|
| 6,173,255 | B1 * | 1/2001 | Wilson et al. | 704/216 |
| 6,718,309 | B1 * | 4/2004 | Selly | 704/503 |
| 6,766,300 | B1 * | 7/2004 | Laroche | 704/500 |
| 2005/0096898 | A1 * | 5/2005 | Singhal | 704/205 |

* cited by examiner

*Primary Examiner*—Jeffrey W Donels
(74) *Attorney, Agent, or Firm*—Robert D. Marshall, Jr.; W. James Brady, III; Frederick J. Telecky, Jr.

(57) ABSTRACT

A time scale modification method employs separate bands obtained through an analysis polyphase filter bank with separate time-scale modification processing for the bands. The outputs are combined using a synthesis filter bank. Some constraints are imposed on the time-scale modification processing, such a limitation of the range of overlap adjustment values for bands other than the greatest energy band, to eliminate noise due to aliasing and inter-channel phase mismatch. This invention produces output quality considerably higher than conventional time-domain time-scale modification methods for general music signals with computational requirements comparable to those of conventional time-domain time-scale modification methods.

12 Claims, 4 Drawing Sheets

TIME-SCALE MODIFICATION OF MUSIC SIGNALS BASED ON POLYPHASE FILTERBANKS AND CONSTRAINED TIME-DOMAIN PROCESSING

TECHNICAL FIELD OF THE INVENTION

The technical field of this invention is digital audio time scale modification.

BACKGROUND OF THE INVENTION

Time-scale modification (TSM) is an emerging topic in audio digital signal processing due to the advance of low-cost, high-speed hardware that enables real-time processing by portable devices. Possible applications include intelligible sound in fast-forward play, real-time music manipulation, foreign language training, etc. Most time scale modification algorithms can be classified as either frequency-domain time scale modification or time-domain time scale modification. Frequency-domain time scale modification provides higher quality for polyphonic sounds, while time-domain time scale modification is more suitable for narrow-band signals such as voice. Time-domain time scale modification is the natural choice in resource-limited applications due to its lower computational cost.

The basic operation of time domain time-scale modification is successively overlapping and adding audio frames, where time scaling is achieved by changing the spacing between them. It is known in the art to calculate the exact overlap point based on a measure of similarity between the signals to be overlapped. This measure of similarity is generally based on cross-correlation.

Most time-domain time-scale modification algorithms are derived from the synchronous overlap-and-add method (SOLA). The synchronous overlap-and-add algorithm and its variations are based on successive overlap and addition of audio frames. For the overlap, the overlap point is adjusted by computing a measure of signal similarity between the overlapping regions for each possible overlap position, which is limited by a minimum and maximum overlap points. The position of maximum similarity is selected. The signal similarity measure can be represented as a full cross-correlation function or simplified versions. This similarity calculation represents about 80% or more of the total computation required by the algorithm.

Even though SOLA based methods represent an attractive low-cost solution to the time-scale modification problem, their limitation stands out in the case of polyphonic music signals. Their intrinsic problem is that the audio signal is treated as a whole without consideration for its individual frequency components, so that the overlap point adjustment based on signal similarity cannot simultaneously generate smooth transitions for the multiple frequency components of the signal.

A family of methods known as phase vocoder does time-scale modification in the frequency domain. The input signal is analyzed at equally spaced overlapping windowed frames using a short-time discrete Fourier transform. Next the phase difference for spectral peaks is calculated. This phase difference is the difference in phase between an input phase and a time scale modified signal phase. An intrinsic sinusoidal model is generally used. The frequency is represented by the sum $\Omega_k+\omega_{ik}$: where carrier $\Omega_k$ is $2\pi k/N$; and $\omega_{ik}$ is an instantaneous frequency modulator. This produces an estimate $\omega ik$ for each spectral line by obtaining the phase difference between two consecutive analysis frames. Here, k is the spectral line and N is the size of the short-time discrete Fourier transform. The process reconstructs an output signal from the analyzed frames using a short-time inverse discrete Fourier transform. The frames are overlapped by a different overlap factor to achieve the desired time scaling. The instantaneous frequency $\omega_{ik}$ is used to calculate the phase corresponding to each spectral line in the time shifted instant.

Even though phase vocoders can potentially achieve higher quality than time-domain methods, a severe limitation is the large amount of computation required in the forward and inverse discrete Fourier transforms and also in the spectrum manipulation process. Practical implementations on fixed-point processors result in a computational cost up to 10 times higher than time-domain time-scale modification methods. In addition, maintaining phase coherence between frames is not an easy task and can be the source of artifacts.

SUMMARY OF THE INVENTION

This invention involves time-scale modification of audio signals. In this invention the input audio signal is separated into a plurality of frequency bands via a filter bank. Time-scale modification is applied separately to the individual frequency bands. The time-scale modification for the greatest energy frequency band is unconstrained. However, the time-scale modification for other frequency bands is constrained to reduce computational costs. The thus modified signals are recombined for output.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
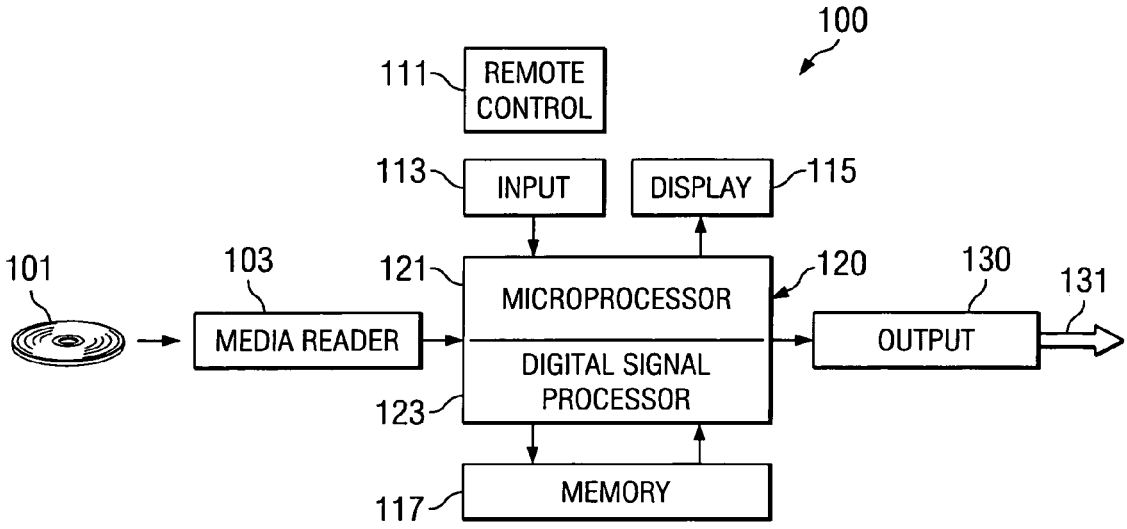
FIG. 1 is a block diagram of a digital audio system to which this invention is applicable.

FIG. 1 is a block diagram illustrating a system to which this invention is applicable. The preferred embodiment is a DVD player or DVD player/recorder in which the time scale modification of this invention is employed with fast forward or slow motion video to provide audio synchronized with the video in these modes.

System 100 received digital audio data on media 101 via media reader 103. In the preferred embodiment media 101 is a DVD optical disk and media reader 103 is the corresponding disk reader. It is feasible to apply this technique to other media and corresponding reader such as audio CDs, removable magnetic disks (i.e. floppy disk), memory cards or similar devices. Media reader 103 delivers digital data corresponding to the desired audio to processor 120.

Processor 120 performs data processing operations required of system 100 including the time scale modification of this invention. Processor 120 may include two different processors microprocessor 121 and digital signal processor 123. Microprocessor 121 is preferably employed for control functions such as data movement, responding to user input and generating user output. Digital signal processor 123 is preferably employed in data filtering and manipulation functions such as the time scale modification of this invention. A Texas Instruments digital signal processor from the TMS320C5000 family is suitable for this invention.

Processor 120 is connected to several peripheral devices. Processor 120 receives user inputs via input device 113. Input device 113 can be a keypad device, a set of push buttons or a receiver for input signals from remote control 111. Input device 113 receives user inputs which control the operation of system 100. Processor 120 produces outputs via display 115. Display 115 may be a set of LCD (liquid crystal display) or LED (light emitting diode) indicators or an LCD display screen. Display 115 provides user feedback regarding the current operating condition of system 100 and may also be used to produce prompts for operator inputs. As an alternative for the case where system 100 is a DVD player or player/recorder connectable to a video display, system 100 may generate a display output using the attached video display. Memory 117 preferably stores programs for control of microprocessor 121 and digital signal processor 123, constants needed during operation and intermediate data being manipulated. Memory 117 can take many forms such as read only memory, volatile read/write memory, nonvolatile read/write memory or magnetic memory such as fixed or removable disks. Output 130 produces an output 131 of system 100. In the case of a DVD player or player/recorder, this output would be in the form of an audio/video signal such as a composite video signal, separate audio signals and video component signals and the like.

Figure 2:
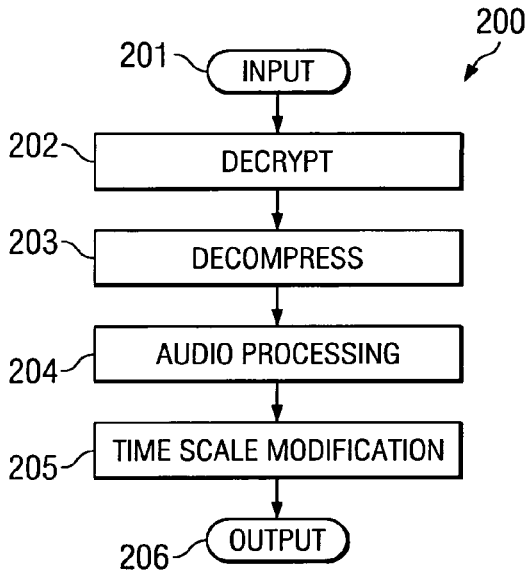
FIG. 2 is a flow chart illustrating the data processing operations involved in time-scale modification employing the digital audio system of FIG. 1.

FIG. 2 is a flow chart illustrating process 200 including the major processing functions of system 100. Flow chart 200 begins with data input at input block 201. Data processing begins with an optional decryption function (block 202) to decode encrypted data delivered from media 101. Data encryption would typically be used for control of copying for theatrical movies delivered on DVD, for example. System 100 in conjunction with the data on media 101 determines if this is an authorized use and permits decryption if the use is authorized.

The next step is optional decompression (block 203). Data is often delivered in a compressed format to save memory space and transmit bandwidth. There are several motion picture data compression techniques proposed by the Motion Picture Experts Group (MPEG). These video compression standards typically include audio compression standards such as MPEG Layer 3 commonly known as MP3. There are other audio compression standards. The result of decompression for the purposes of this invention is a sampled data signal corresponding to the desired audio. Audio CDs typically directly store the sampled audio data and thus require no decompression.

The next step is audio processing (block 204). System 100 will typically include audio data processing other than the time scale modification of this invention. This might include band equalization filtering, conversion between the various surround sound formats and the like. This other audio processing is not relevant to this invention and will not be discussed further.

The next step is time scale modification (block 205). This time scale modification is the subject of this invention and various techniques of the prior art and of this invention will be described below in conjunction with FIGS. 3 to 6. Flow chart 200 ends with data output (block 206).

Figure 3:
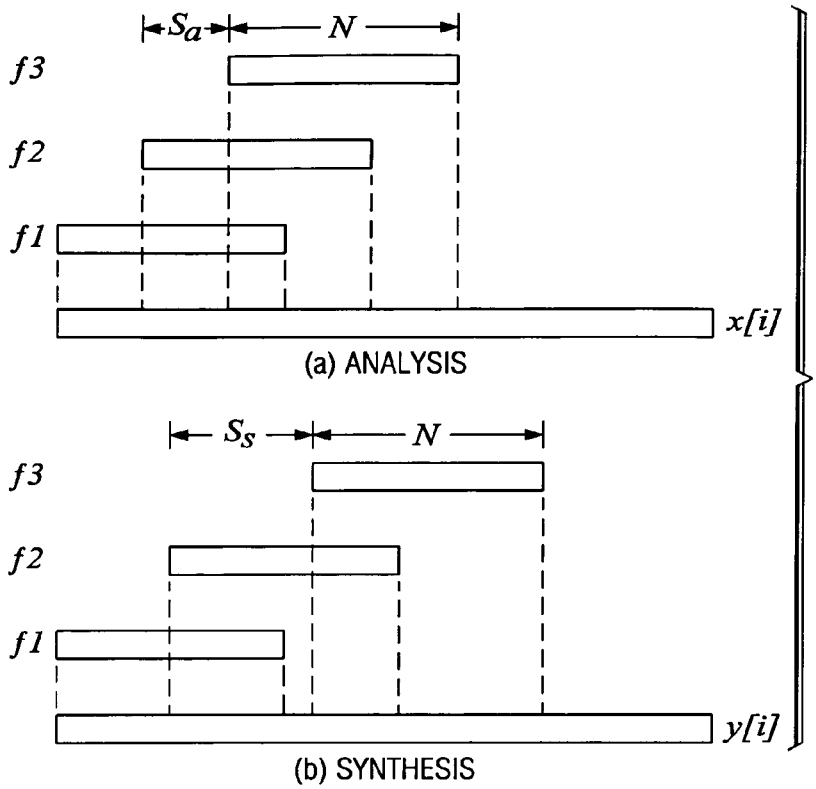
FIG. 3 (PRIOR ART)
FIG. 3*a* illustrates the analysis step in the overlap and add method of time scale modification according to the prior art.
FIG. 3*b* illustrates the synthesis step in the overlap and add method of time-scale modification according to the prior art.

FIG. 3 illustrates this process. In FIG. 3(*a*), x(i) is the analysis signals represented as a sequence with index i. Similarly, FIG. 3(*b*) illustrates synthesis signal y(i) having a sequence index i. The quantity N is the frame size. $S_a$ is the analysis frame interval between consecutive frames $f_j$ (where j=1, 2 . . . ). $S_s$ is the similar synthesis frame interval. The relationship between the analysis frame interval $S_a$ and the synthesis frame interval $S_s$ sets the time scale modification. The overlap-and-add time scale modification algorithm is simple and provides acceptable results for small time-scale factors. In general this method yields poor quality compared to other methods described below.

The synchronous overlap-and-add time scale modification algorithm is an improvement over the previous overlap-and-add approach. Instead of using a fixed overlap interval for synthesis, the overlap point is adjusted by computing the normalized cross-correlation between the overlapping regions for each possible overlap position within minimum and maximum deviation values. The overlap position of maximum cross-correlation is selected. The cross-correlation is calculated using the following formula, where $L_k$ is the length of the overlapping window:

$$R[k] = \frac{\sum_{i=0}^{L_k-1} y[mS_s + k + i] \times [mS_a + i]}{\left[\sum_{i=0}^{L_k-1} y^2[mS_s + k + i] \sum_{i=0}^{L_k-1} x^2[mS_a + i]\right]^{1/2}} \quad (1)$$

Figure 4:
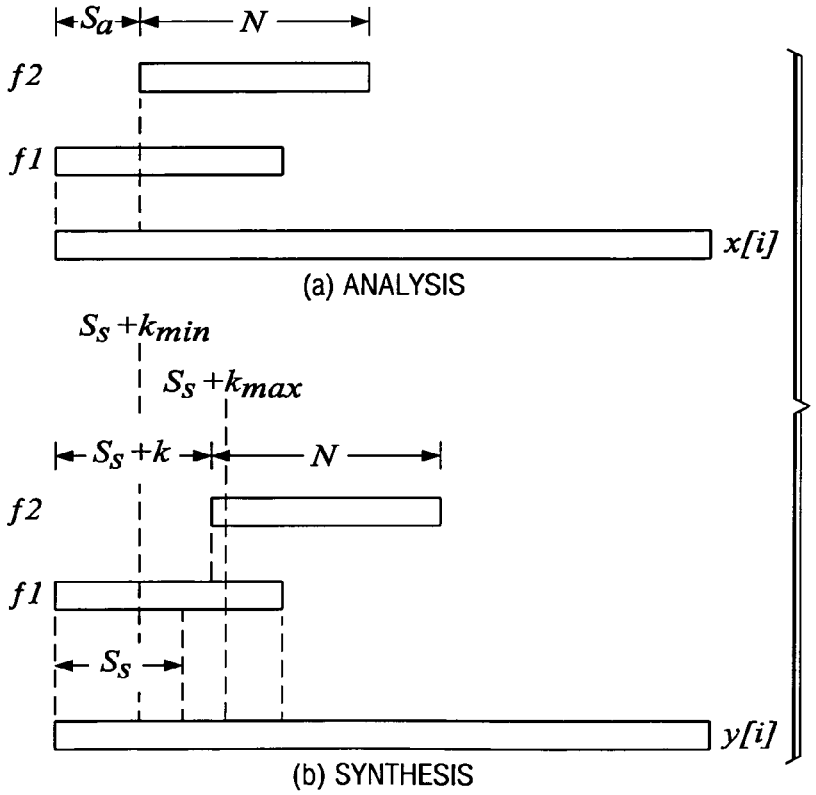
FIG. 4 (PRIOR ART)
FIG. 4*a* illustrates the analysis step in synchronous overlap and add method of time scale modification according to the prior art.
FIG. 4*b* illustrates the synthesis step in the synchronous overlap and add method of time-scale modification according to the prior art.

FIG. 4 illustrates the synchronous overlap-and-add time scale modification algorithm. The same variables are used in FIG. 4(*a*) for analysis as FIG. 3(*a*) and used in FIG. 4(*b*) for synthesis as in 3(*b*). In FIG. 4, k is the deviation of the overlap position, with k limited to the range between $k_{min}$ and $k_{max}$. Note that k=0 is equivalent to the overlap-and-add time scale modification algorithm illustrated in FIGS. 3(*a*) and 3(*b*). The synchronous overlap-and-add time scale modification algorithm requires a large amount of computation to calculate the normalized cross-correlation used in equation 1. The similarity computation can be reduced using a more efficient normalized cross-correlation formula or another measure of signal similarity instead of equation 1. Even such a reduced computation will still be the most computation-expensive part of the algorithm. The following discussion applies to whatever normalized cross-correlation formula or measure of signal similarity is used. This computation enables better phase matching for each overlapping frame, thus improving the resulting sound quality.

Figure 5:
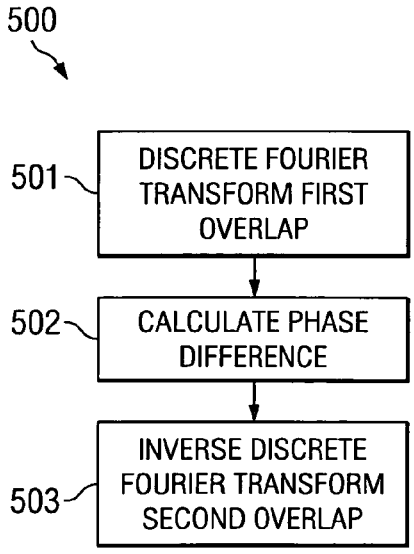
FIG. 5 (PRIOR ART)
FIG. 5 is a flow chart illustrating the steps in the prior art phase vocoder time scale modification technique.

FIG. 5 is a flow chart illustrating process 500 including the basic phase vocoder as known in the art. At block 501 the input signal is analyzed at equally spaced overlapping windowed frames using a short-time discrete Fourier transform. The resulting data describes short time intervals of the audio data in the frequency domain. Next the phase difference for spectral peaks is calculated (block 502). This phase difference is the difference in phase between an input phase and a time scale modified signal phase. Block 502 uses an intrinsic sinusoidal model where the frequency is represented by the sum $\Omega_k+\omega_{ik}$: where carrier $\Omega_k$ is $2\pi k/N$; and $\omega_{ik}$ is an instantaneous frequency modulator. Block 502 estimates $\omega_{ik}$ for each spectral line by obtaining the phase difference between two consecutive analysis frames. Here, k is the spectral line and N is the size of the short-time discrete Fourier transform.

Process 500 reconstructs an output signal from the analyzed frames using a short-time inverse discrete Fourier transform (block 503). The frames are overlapped by a different overlap factor to achieve the desired time scaling. The instantaneous frequency $\omega_{ik}$ is used to calculate the phase corresponding to each spectral line in the time shifted instant.

Figure 6:
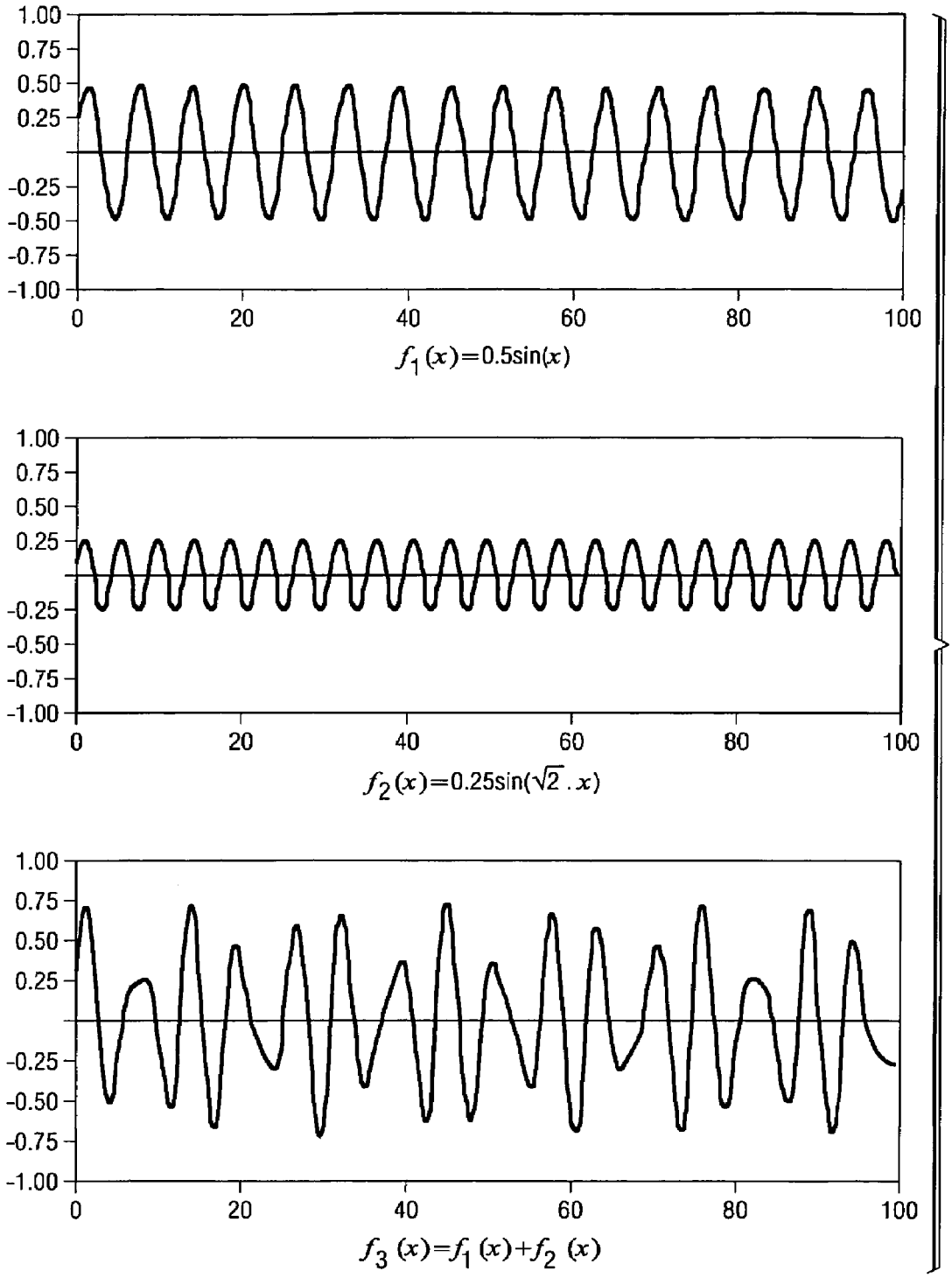
FIG. 6 is a view of several waveforms used in explanation of this invention.

Consider a simple signal consisting of non-harmonically related frequencies, such as $f_1=0.5\sin(x)$ and $f_2=0.25\sin(\sqrt{2}x)$ and their sum $f_3$ illustrated in FIG. 6. Because the signals $f_1$ and $f_2$ are not harmonically related, any instantaneous relationship between their respective phases will never be repeated exactly because a perfect match would require an integer number of periods of both signals. Thus a time-domain time-scale modification technique would try to find a close match within signal $f_3$ but there will always be some phase disruption when jumping to a different location. This phase match problem causes artifacts for many time-domain time-scale modification techniques. Now consider separating these components and performing a similar operation on each signal individually. In this case, there is little problem finding a perfect phase match for each signal, though it will be at different locations. Combining the resulting time-scaled signals produces an artifact-free time-scaled whole. Unfortunately in the real world, even narrow band signals do not repeat perfectly due to changes in pitch and amplitude, and to interference among close frequencies. However analysis in separate frequency bands gives each band great flexibility in finding the best overlap point. This improves overall quality.

Figure 7:
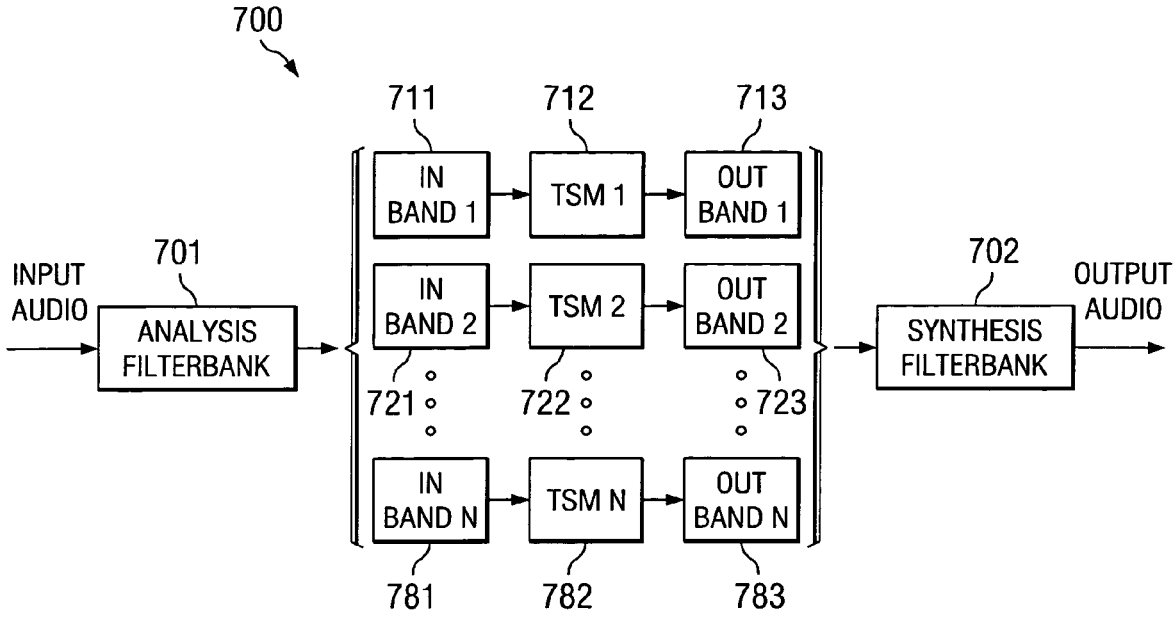
FIG. 7 is a process diagram illustrating the processes of this invention.

FIG. 7 illustrates the filter bank time-scale modification method of this invention. Analysis filter bank 701 receives the input audio and generates N band limited signal in N respective frequency bands. The exact number and nature of these bands depends on the implementation and can be varied to meet various requirements including quality and computational complexity. Bands equally spaced in frequency enable the use of fast filter bank techniques to reduce the computational load. Frequency bands selected based on a Bark scale partition of the spectrum each have about the same relevance in human perception. Bark scale frequency bands are more complex computationally but are better psychoacoustically. Analysis filter bank 701 can be a set of band pass finite impulse response (FIR) filters. These are preferably designed so that the bands could be simply summed in synthesis filter bank 702 to perfectly reconstruct the original signal. Each frequency undergoes some input processing (In band blocks 711, 721 . . . 781). Next each frequency band is subject to time-domain time-scale modification via the corresponding TSM unit 712, 722 . . . 782. Following output processing (Out band blocks 713, 723 . . . 783), synthesis filter bank 702 recombines the outputs.

The preferred embodiment uses an analysis polyphase filter bank 701 that divides the input signal into 32 equal-bandwidth bands. Time-domain time-scale modification is executed separately on each band. The outputs are then recombined in synthesis filter bank 702.

The analysis/synthesis filter banks are preferably implemented using MPEG-audio specifications. These filters divide the input audio signal into 32 subsampled bands with a decimation factor of 32. Thus, the total amount of data in all bands is equal to the original amount of input data. The filters of the filter bank are preferably implemented by modulating a prototype low-pass filter. This technique provides a reasonable trade-off between frequency and time resolution. These filters cannot achieve perfect reconstruction in the strict sense, but offer the advantage of low computational cost. Other filter bank implementations are possible and can potentially provide better frequency resolution and better reconstruction. However, this implementation is advantageous if the invention is used in conjunction with an MPEG audio decoder in devices such as portable MP3 players. In such decoders, the polyphase filter is implemented by the decoder and the subband data are available at no additional cost.

Figure 8:
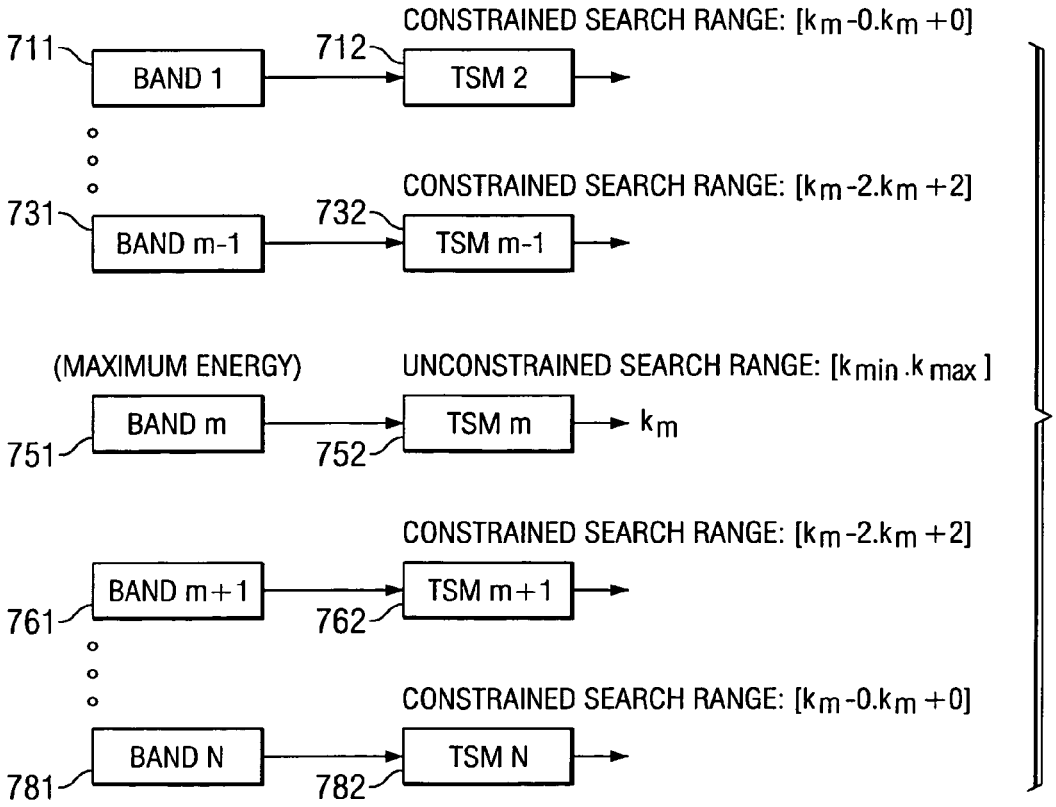
FIG. 8 is a process diagram illustrating the time-scale modification constraints according to one embodiment of this invention.

FIG. 8 illustrates a further refinement of this invention. It is known in phase vocoders to keep a certain level of coherence among the frequencies of the spectrum in order to avoid reverberation due to interference known as beating. As shown in FIG. 8, this invention includes a mechanism to enforce phase coherence among the frequency bands of the signal. This refinement also reduces aliasing exposed by the time-domain manipulation of the bands.

In FIG. 8, band m has the greatest energy content. This energy content can be estimated from the short-term RMS power calculated on the input frame. In this example the time-scale modification used is synchronous overlap/add method. For band m, the frequency band with the greatest energy, the correlation computation is made over the whole range of k from $k_{min}$ to $k_{max}$ (see equation 1 and FIG. 4*b*). The greatest correlation results from a value of $k_m$, whereby time-scale modification unit 752 uses an overlap value of $S_s+k_m$. After obtaining this overlap adjustment value $k_m$ for the highest energy band, the overlap adjustment values for the neighboring frequency bands m−1 and m+1 are obtained from a narrower range of k between $k_m-2$ and $k_m+2$. Thus time-scale modification units 732 and 762 use an overlap value k selected from this narrower range. Frequency bands still further distant, such as bands 1 and N of FIG. 8, employ an even narrower range of k. FIG. 8 illustrates the case where these most distant frequency bands 1 and N are limited to the range of k between $k_m-0$ and $k_m+0$. Thus corresponding time-scale modification units 712 and 782 use the overlap adjustment value of $k_m$ obtained from the highest energy band m.

Constraints on the range of overlap adjustment value k for other bands reduces the time delay and consequently phase mismatch between these neighboring bands (m−1, m+1) and the highest energy band m. The constrained width of the search length and the number of bands around the maximum energy band to be constrained are 2 parameters that enable control of the amount of aliasing noise and inter-band phase mismatch in the reconstructed audio. Such aliasing noise and inter-band phase mismatch may be completely eliminated by imposing a severe constraint, such as forcing all bands to use the overlap value $k_m$ of the maximum energy band. In that case, the resulting output will sound rougher due to the lack of smooth concatenation within these other bands. If no constraints are applied, then the output will sound smoother due to the good intra-band concatenation but some noise would be produced due to lack of alias cancellation and inter-band phase mismatch. This invention proposed a trade-off between these extreme cases. This invention allows flexibility in terms of the specific constraint on the search length of overlap adjustment values.

This invention achieves high output quality for polyphonic and monophonic music signals due to the separate processing executed on the various frequency components of the signal, in combination with some constraints to reduce noise due to aliasing and phase mismatch among channels. However, conventional time-domain modification methods or parametric methods may provide higher quality for pure speech signals.

Computational cost is low because the time-scale modification processing is executed on subsampled bands. The total computation resulting from all bands are approximately the same as the computation consumed by conventional time-domain time scale modification. Moreover, the computation can be further reduced by skipping some of the time-scale modification processing of low-energy bands. That reduction compensates for the additional overhead from the analysis/synthesis filter banks.

This invention is especially useful in conjunction with an MPEG audio decoder. An MPEG audio decoder includes the polyphase filter bank in the decoder that could be used directly by this invention. In this case, the subband domain data and the synthesis filter bank are already provided by the MPEG audio decoder and do not increase computational cost. In this case, the computational cost of this invention will be the same or smaller than conventional time-domain time-scale modification methods while providing higher quality.

Listening tests indicate that the quality achieved by this invention is clearly higher than conventional time-domain time-scale modification for music signals in general, whether polyphonic or not, for both for fast and slow playback. This invention also achieves high quality for speech signals, but a peculiar alias-type high-frequency noise is heard. This effect can be reduced to acceptable levels using the constraints described above.

What is claimed is:

1. A method of time-scale modification of a digital audio signal comprising the steps of:

separating the digital audio signal into a plurality of frequency bands;

detecting the energy in each frequency band;

determining the frequency band having the highest energy;

separately time-scale modifying each of the plurality of frequency bands producing corresponding time-scale modified frequency band signals by analyzing each frequency band in a set of first equally spaced, overlapping time windows having a first overlap amount $S_a$, selecting a base overlap $S_s$ for output synthesis corresponding to a desired time scale modification, calculating a measure of similarity between overlapping frames of the frequency band having the highest energy for a range of overlaps between $S_s+k_{min}$ to $S_s+k_{max}$ of the single audio signal, where $k_{min}$ is a minimum overlap deviation and $k_{max}$ is a maximum overlap deviation, determining an overlap deviation $k_m$ yielding the largest measure of similarity for the frequency band having the highest energy, calculating a measure of similarity between overlapping frames of frequency bands other than the highest energy frequency band for a range of overlaps around $k_m$ smaller than the range between $S_s+k_{min}$ to $S_s+k_{max}$, determining an overlap deviation $k_i$ yielding the largest measure of similarity for each frequency band other than having the highest energy frequency band, synthesizing an output signal for each frequency band in a set of second equally spaced, overlapping time windows having the corresponding determined overlap amount; and combining the separate time-scale modified frequency band signals.

2. The method of claim 1, wherein:

said step of calculating a measure of similarity between overlapping frames of frequency bands other than the highest energy frequency band calculates the measure of similarity for frequency bands adjacent to the highest energy frequency bands in a range of overlaps between $k_m-1$ and $k_m+1$.

3. The method of claim 1, wherein:

said step of determining an overlap deviation $k_i$ for frequency bands most distant from the highest energy frequency band determines an overlap deviation of $k_m$.

4. The method of claim 1, wherein:

the digital audio signal consists of an MPEG Layer 3 compressed audio signal; and said step of separating the digital audio signal into a plurality of frequency bands includes decoding the MPEG Layer 3 compressed audio signal into a plurality of decimated subbands, and employing the decimated subbands as the plurality of frequency bands.

5. The method of claim 1, wherein:

said step of separating the digital audio signal into a plurality of frequency bands employs equally spaced frequency bands.

6. The method of claim 1, wherein:

said step of separating the digital audio signal into a plurality of frequency bands employs frequency bands selected according to a Bark scale where each frequency band has an extent dependent upon human frequency perception.

7. A digital audio apparatus comprising:

a source of a digital audio signal;

a digital signal processor connected to said source of a digital audio signal programmed to perform time scale modification on the digital audio signal by separating the digital audio signal into a plurality of frequency bands, detecting the energy in each frequency band;

determining the frequency band having the highest energy;

separately time-scale modifying each of the plurality of frequency bands producing corresponding time-scale modified frequency band signals by analyzing each frequency band in a set of first equally spaced, overlapping time windows having a first overlap amount $S_a$, selecting a base overlap $S_s$ for output synthesis corresponding to a desired time scale modification, calculating a measure of similarity between overlapping frames of the frequency band having the highest energy for a range of overlaps between $S_s+k_{min}$ to $S_s+k_{max}$ of the single audio signal, where $k_{min}$ is a minimum overlap deviation and $k_{max}$ is a maximum overlap deviation, determining an overlap deviation $k_m$ yielding the largest measure of similarity for the frequency band having the highest energy, calculating a measure of similarity between overlapping frames of frequency bands other than the highest energy frequency band for a range of overlaps around $k_m$ smaller than the range between $S_s+k_{min}$ to $S_s+k_{max}$, determining an overlap deviation $k_i$ yielding the largest measure of similarity for each frequency band other than having the highest energy frequency band, synthesizing an output signal for each frequency band in a set of second equally spaced, overlapping time windows having the corresponding determined overlap amount, combining the separate time-scale modified frequency band signals; and an output device connected to the digital signal processor for outputting the time scale modified digital audio signal.

8. The digital audio apparatus of claim 7, wherein:

said digital signal processor is programmed to calculate the measure of similarity for frequency bands adjacent to the highest energy frequency bands in a range of overlaps between $k_m-1$ and $k_m+1$.

9. The digital audio apparatus of claim 7, wherein:

said digital signal processor is programmed to determine an overlap deviation of $k_m$ for frequency bands most distant from the highest energy frequency band.

10. The digital audio apparatus of claim 7, wherein:

said source of a digital audio signal produces an MPEG Layer 3 compressed audio signal; and said digital signal processor is programmed to decode said MPEG Layer 3 compressed audio signal into a plurality of decimated subbands, and employ the decimated subbands as the plurality of frequency bands.

11. The digital audio apparatus of claim 7, wherein:

said digital signal processor is programmed to separate the digital audio signal into a plurality of equally spaces frequency bands.

12. The digital audio apparatus of claim 7, wherein:

said digital signal processor is programmed to separate the digital audio signal into a plurality of frequency bands employing frequency bands selected according to a Bark scale where each frequency band has an extent dependent upon human frequency perception.

* * * * *